US010731462B2

(12) United States Patent
Bauer

(10) Patent No.: US 10,731,462 B2
(45) Date of Patent: Aug. 4, 2020

(54) TUNNEL SYSTEM

(71) Applicant: Hyperloop Technologies, Inc., Los Angeles, CA (US)

(72) Inventor: Anthony Bauer, Los Angeles, CA (US)

(73) Assignee: HYPERLOOP TECHNOLOGIES, INC., Los Angeles, CA (US)

( * ) Notice: Subject to any disclaimer, the term of this patent is extended or adjusted under 35 U.S.C. 154(b) by 0 days.

(21) Appl. No.: 16/256,366

(22) Filed: Jan. 24, 2019

(65) Prior Publication Data

US 2019/0226341 A1 Jul. 25, 2019

Related U.S. Application Data

(60) Provisional application No. 62/621,321, filed on Jan. 24, 2018.

(51) Int. Cl.

| | |
|---|---|
| ***E21D 11/38*** | (2006.01) |
| ***E21D 11/08*** | (2006.01) |
| *E02B 3/16* | (2006.01) |
| *E02D 29/16* | (2006.01) |
| *E21D 11/40* | (2006.01) |

(52) U.S. Cl.

CPC ..... *E21D 11/385* (2013.01); *E21D 11/083* (2013.01); *E02B 3/16* (2013.01); *E02D 29/16* (2013.01); *E21D 11/40* (2013.01)

(58) Field of Classification Search

CPC ..... E21D 11/385; E21D 11/083; E02B 3/16; E02D 29/16

See application file for complete search history.

(56) References Cited

U.S. PATENT DOCUMENTS

| | | | | |
|---|---|---|---|---|
| 1,788,248 | A | 1/1931 | O'Rourke | |
| 3,695,044 | A * | 10/1972 | Hoshino | E21D 5/012 405/152 |
| 3,815,370 | A | 6/1974 | Lennox | |
| 3,861,154 | A | 1/1975 | Cooper | |
| 4,397,583 | A * | 8/1983 | Horncy | E21D 11/086 405/150.1 |
| 5,044,823 | A * | 9/1991 | Burgess | E21D 11/385 277/646 |
| 5,439,319 | A * | 8/1995 | Flanagan | E21D 11/383 156/287 |
| 6,592,296 | B2 * | 7/2003 | Gutschmidt | E21D 11/385 277/628 |
| 6,761,504 | B1 | 7/2004 | Brandenberger et al. | |
| 9,388,691 | B2 * | 7/2016 | Peters | E21D 11/08 |
| 2011/0188939 | A1 | 8/2011 | Sanders | |

(Continued)

FOREIGN PATENT DOCUMENTS

CN 107012892 * 4/2017

OTHER PUBLICATIONS

Int'l Search Report (Form PCT/ISA/210) conducted in counterpart Int'l Appln. No. PCT/US2019/014988 (dated Apr. 12, 2019).

(Continued)

*Primary Examiner* — Carib A Oquendo

(74) *Attorney, Agent, or Firm* — Greenblum & Bernstein P.L.C.

(57) ABSTRACT

A tunnel system includes at least two adjacent tunnel lining systems and a sealing system. Moreover, the tunnel lining systems can include plural tunnel lining segments.

19 Claims, 6 Drawing Sheets

(56) References Cited

U.S. PATENT DOCUMENTS

| | | | |
|---|---|---|---|
| 2015/0192014 | A1 | 7/2015 | Carr |
| 2018/0009180 | A1 | 1/2018 | Hammer et al. |

OTHER PUBLICATIONS

Int'l Search Report (Form PCT/ISA/220) conducted in counterpart Int'l Appln. No. PCT/US2019/014988 (dated Apr. 12, 2019).
Written Opinion (Form PCT/ISA/237) conducted in counterpart Int'l Appln. No. PCT/US2019/014988 (dated Apr. 12, 2019).

* cited by examiner

TUNNEL SYSTEM

CROSS-REFERENCE TO RELATED APPLICATION

This application claims the benefit under 35 U.S.C. § 119(e) of U.S. Provisional Application No. 62/621,321 filed Jan. 24, 2018, the disclosure of which is expressly incorporated by reference herein in its entirety.

BACKGROUND OF THE DISCLOSURE

Construction of tubes can prove to be difficult. The limitations of tube construction can be especially felt when the application that calls for the tubes requires a long, contiguous tube length. For instance, a structure may become limited in its general layout when the structure may span greater distances. Additionally, if the tube is built in portions, or sections, the tubes may be prone to leaking due to the joining of the portions or sections. This can be particularly limiting as the span of the structure increases.

SUMMARY OF EMBODIMENTS OF THE DISCLOSURE

The present disclosure is related to a tunnel system, which can include a tunnel lining system and a sealing system. The sealing system, which can ensure air tightness of the tunnel lining system, can sustain a low-pressure environment inside the tunnel system.

Embodiments are directed to a tunnel system that includes at least two adjacent tunnel lining systems; and a sealing system.

According to embodiments, the tunnel lining systems can be ring-shaped and may include an outer wall, an inner wall and radial walls, and the adjacent tunnel lining systems are oriented so respective radial walls face each other. The sealing system may include at least one outer gasket formed at least on the respective radial walls facing each other adjacent the outer wall and at least one inner gasket formed at least on the respective radial walls facing each other adjacent the inner wall.

In embodiments, the at least one outer gaskets on the respective radial walls facing each other can be under a compression force to abut each other and the at least one inner gaskets on the respective radial walls facing each other can be under a compression force to abut each other. Further, a channel defined by the abutting at least one outer gaskets, the abutting at least one inner gaskets and the respective radial walls facing each other may be filled with grout. The grout may be an injectable synthetic grout, and the at least one outer and inner gaskets may include an elastomeric rubber material.

According to other embodiments, the tunnel system may include a membrane applied to the inner walls of the adjacent tunnel lining systems. The membrane can include one of a spray-applied polymer coating or thermoplastic membrane lining.

In embodiments, the tunnel lining systems may include a plurality of tunnel lining segments.

According to other embodiments, the tunnel lining segments may include an outer wall, an inner wall and axial walls, and the tunnel lining segments can be connected together in series at their axial walls. The sealing system may include at least one outer gasket formed at least on the axial walls adjacent the outer wall and at least one inner gasket formed at least on the axial walls adjacent the inner wall. The at least one outer gaskets on the axial walls can be under a compression force to abut each other and the at least one inner gaskets on the axial walls may be under a compression force to abut each other. Still further, the sealing system may further include radial gaskets on the axial walls extending between the at least one outer gaskets and the at least one inner gaskets. The radial gaskets in consecutive tunnel lining segments may be under a compression force to abut each other. Further, a channel defined by the abutting at least one outer gaskets, the abutting at least one inner gaskets, the abutting radial gaskets and the axial walls can be filled with grout.

In accordance with still other embodiments, the tunnel lining segments may include an outer wall, an inner wall, radial walls and axial walls. The tunnel lining segments may be connected together in series at their axial walls to form tunnel lining systems and the tunnel lining systems may be connected together in series at their radial walls. The sealing system may include at least one outer gasket surrounding a periphery of the tunnel lining segments adjacent the outer wall, at least one inner gasket surrounding a periphery of the tunnel lining segments adjacent the inner wall, and radial gaskets formed on the axial ends between the at least one outer gasket and the at least one inner gasket. When the tunnel lining segments are connected together in series at their axial walls to form tunnel lining systems, the at least one outer gaskets on consecutive axial walls may be under a compression force to abut each other, the at least one inner gaskets on consecutive axial walls may be under a compression force to abut each other, and the radial gaskets on consecutive axial walls may be under a compression force to abut each other. When the tunnel lining systems are connected together in series at their radial walls, the at least one outer gaskets on consecutive radial walls can be under a compression force to abut each other and the at least one inner gaskets on consecutive radial walls can be under a compression force to abut each other.

According to other embodiments, the tunnel lining segments can include grout ports communicating between the radial wall and the inner wall.

In accordance with still yet other embodiments, the sealing system may further include a synthetic grout filling a grout channel formed between consecutive axial walls and formed between consecutive radial walls. Moreover, the tunnel system can further include a membrane covering at least one of the inner and outer walls of the tunnel lining segments.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS OF THE DISCLOSURE

Figure 1:
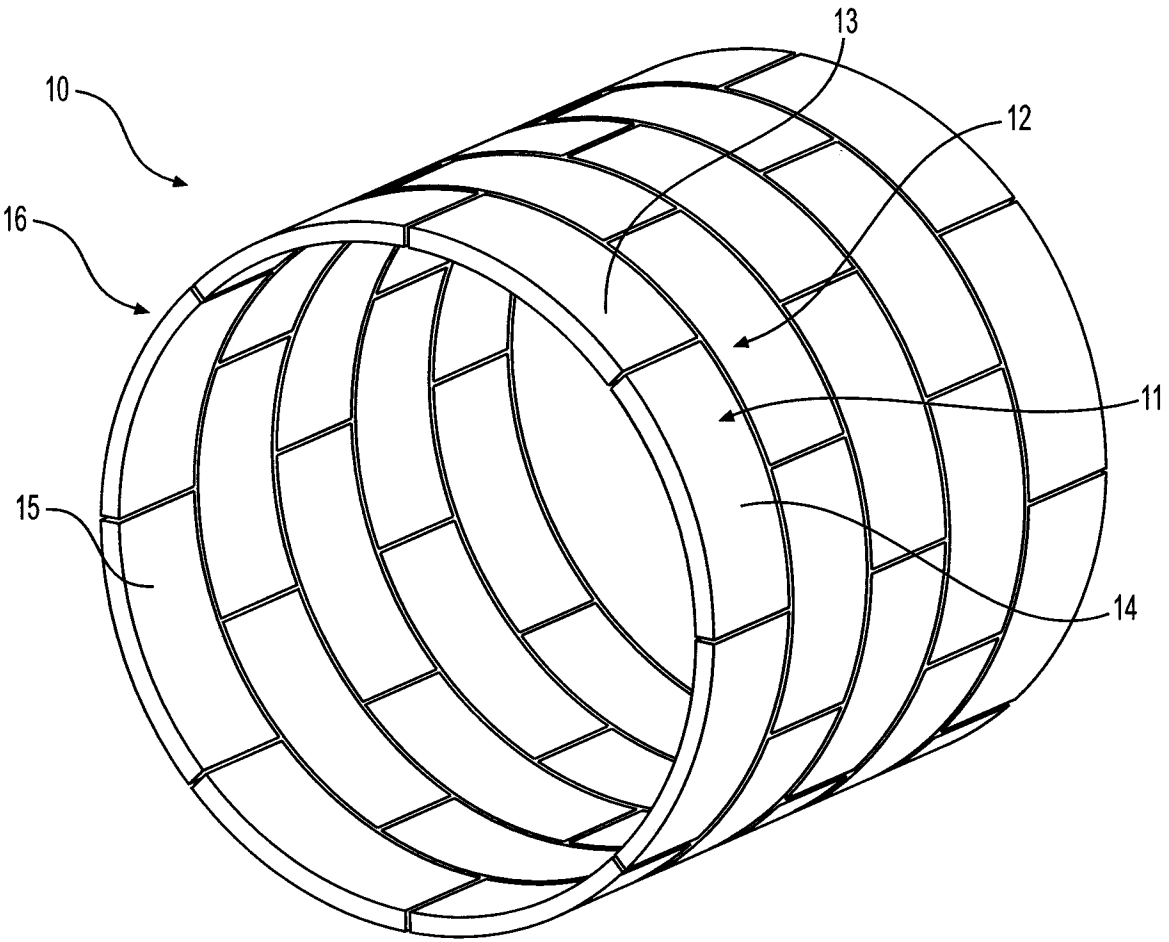
FIG. 1 illustrates an exemplary embodiment of a tunnel system.

The following detailed description illustrates by way of example, not by way of limitation, the principles of the disclosure. This description will clearly enable one skilled in the art to make and use the disclosure, and describes several embodiments, adaptations, variations, alternatives and uses of the embodiments of the disclosure, including what is presently believed to be the best mode of carrying out the embodiments of the disclosure. It should be understood that the drawings are diagrammatic and schematic representations of exemplary embodiments of the invention, and are not limiting of the present disclosure nor are they necessarily drawn to scale.

As used herein and elaborated below, the terms "about," "substantially," "significantly," or "approximately" for any numerical values, ranges, shapes, distances, relative relationships, etc. indicate a suitable dimensional tolerance that allows the part or collection of components to function for its intended purpose as described herein.

The novel features which are characteristic of the disclosure, both as to structure and method of operation thereof, together with further objects and advantages thereof, will be understood from the following description, considered in connection with the accompanying drawings, in which an embodiment of the disclosure is illustrated by way of example. It is to be expressly understood, however, that the drawings are for the purpose of illustration and description only, and they are not intended as a definition of the limits of the disclosure.

Embodiments of the present disclosure may be used in a transportation system, for example, as described in commonly-assigned application Ser. No. 15/007,783, titled "Transportation System," the contents of which are hereby expressly incorporated by reference herein in their entirety.

In the following description, the various embodiments of the present disclosure will be described with respect to the enclosed drawings. As required, detailed embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded. As used herein, the indefinite article "a" indicates one as well as more than one and does not necessarily limit its referent noun to the singular.

Except where otherwise indicated, all numbers expressing quantities used in the specification and claims are to be understood as being modified in all examples by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for example a composition comprising a compound A may include other compounds besides A. However, the term "comprising" also covers the more restrictive meanings of "consisting essentially of" and "consisting of", so that for example "a composition comprising a compound A" may also (essentially) consist of the compound A.

The various embodiments disclosed herein can be used separately and in various combinations unless specifically stated to the contrary.

FIG. 1 illustrates an exemplary embodiment of a tunnel system in accordance with aspects of the disclosure.

As shown in FIG. 1, the tunnel system 10 can include at least two tunnel lining system 11 and a sealing system 12. The tunnel lining system 11 may include two or more tunnel lining segments 13, e.g., six tunnel lining segments, and the sealing system 12 may include two or more gaskets 16. Tunnel lining segments 13 may include an outer wall 14 and an inner wall 15. Tunnel lining segments 13 can be joined together to create the ring-shaped tunnel lining system 11. Tunnel lining segments 13 can be formed by, e.g., precast concrete or other suitable material.

Sequentially assembled tunnel lining systems 11 interposed by sealing systems 12 may be longitudinally positioned to define tunnel system 10. Adjacent tunnel lining segments may be connected at longitudinal terminal ends such that a reduced or low-pressure environment, and preferably substantially air-tight environment, may be maintained along a length of two or more tunnel lining rings. Moreover, the tunnel system may be advantageously used to facilitate a low-pressure environment for use in a transportation system.

Figure 2:
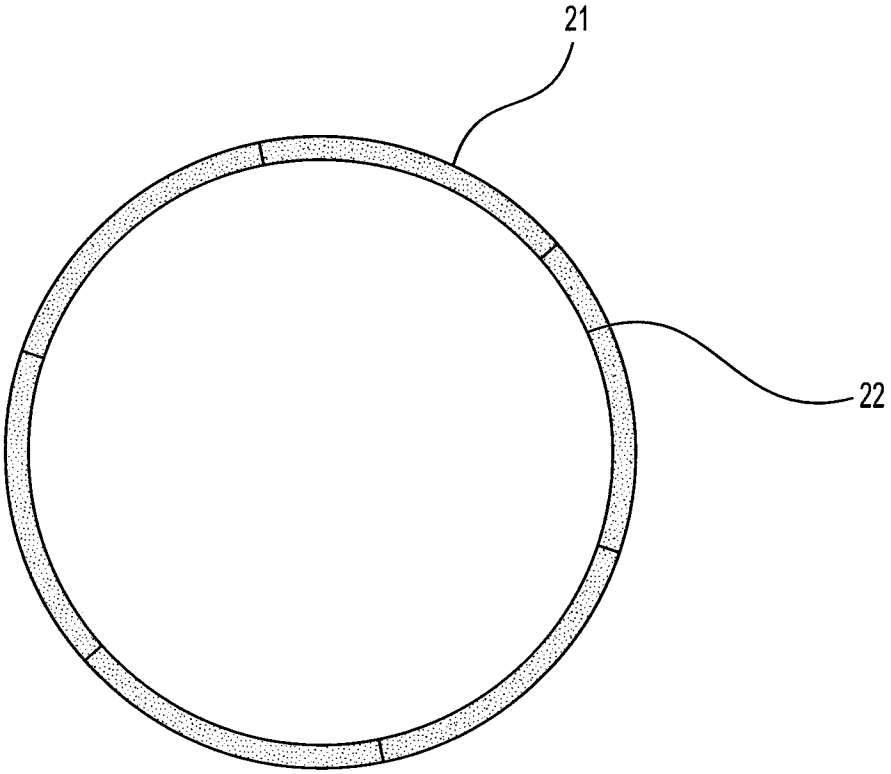
FIG. 2 illustrates a cross-sectional view of the tunnel system.

FIG. 2 shows a cross-sectional view of the tunnel system 21 configured to facilitate a low-pressure environment for use in a transportation system. In this exemplary illustration, a membrane 22 is applied to the inner wall of tunnel system 21. However, it is understood that membrane 22 can be applied to inner and/or outer walls of tunnel system 21 to provide a continuous and/or segmented membrane without departing from the spirit and scope of the embodiments. Membrane 22 can be applied to the inner and/or outer walls of tunnel system 21 by either (i) coating the walls with a spray-applied polymer coating, e.g., epoxy, polyuria, etc., or (ii) lining the walls with a manufactured thermoplastic membrane, e.g., HDPE, PP, PVDF, ECTFE, etc.

Moreover, while not shown in FIG. 2, the finished tunnel system can be provided with two or more rails by which a transport pod may be guided through the tunnel system. The rails may be substantially laterally arranged, but it is understood that the rails may curve to accommodate changes. The rails may be located on a bottom of the tunnel system or at a top of the tunnel system. Further, the rails may be located on opposite sides of the tube segment, such that each side has at least one rail. The rails may run approximately parallel to each other along the length of the tunnel system.

Figure 3:
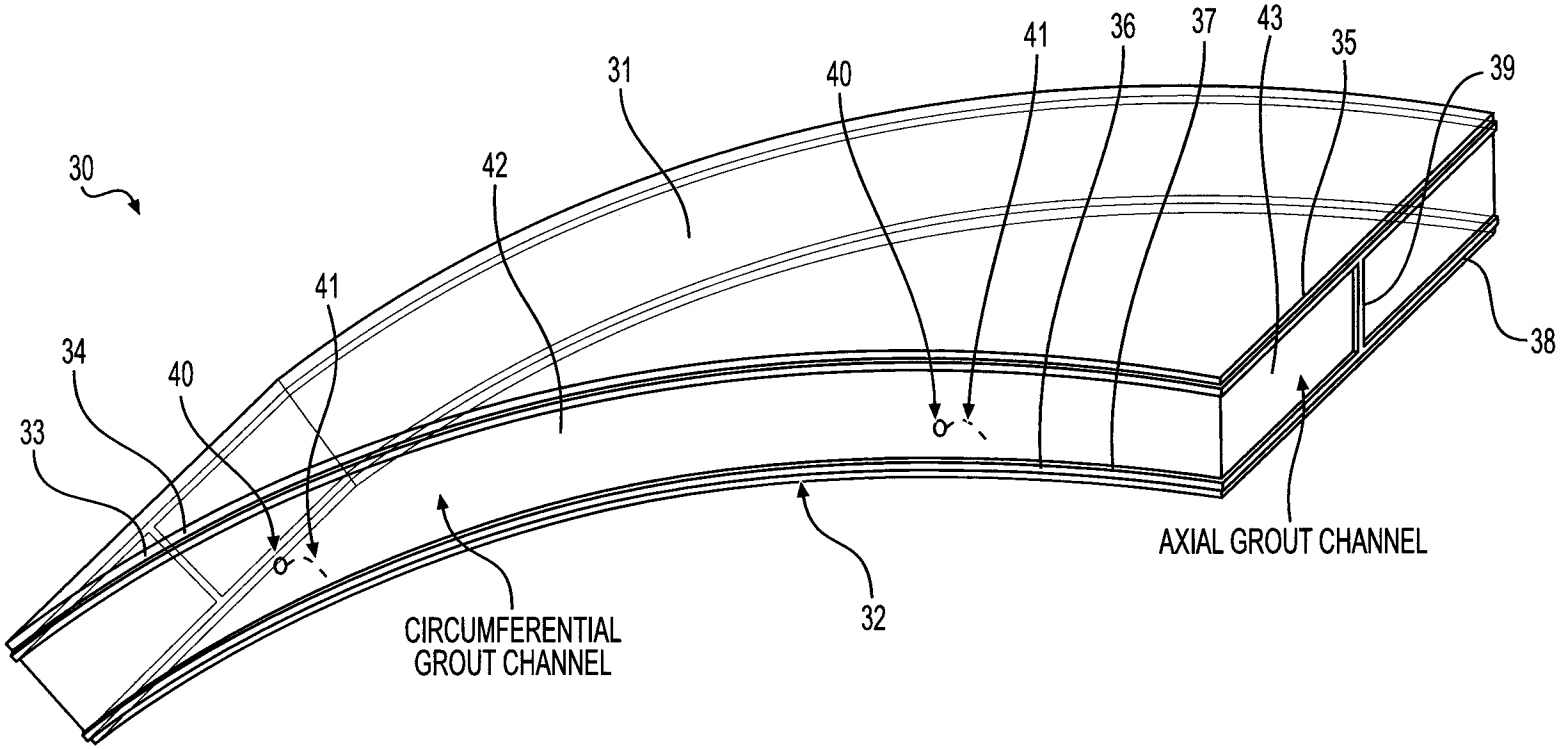
FIG. 3 illustrates an exemplary embodiment of a tunnel lining segment.

As shown in FIG. 1, each tunnel lining system 11 can be formed by plural tunnel lining segments 13. An exemplary tunnel lining segment 30 is illustrated in FIG. 3. Tunnel lining segment 30 includes outer wall 31, inner wall 32, radial walls 42 and axial walls 43. Further, sealing system 14 includes at least one outer gasket 33 arranged on the radial walls 42 and axial walls 43 to surround outer wall 31 and at least one inner gasket 36 arranged on the radial walls 42 and axial walls 43 to surround inner wall 32. Thus, the at least one outer gasket 33 forms outer circumferential gaskets 34 in radial walls 42 and axial outer gaskets 35 in axial walls 43, and the at least one inner gasket 36 forms inner circumferential gaskets 36 in radial walls 42 and axial inner gaskets 37 in axial walls 43. A radial gasket 39 extends between axial outer gaskets 38 and axial inner gaskets 37.

The inner and outer gaskets 33, 36 will be made of an elastomeric rubber material, such as EPDM, which is flexible, durable and air-tight when installed in the arrangement shown. The inner and outer gaskets 33, 36 are generally arranged around the inner and outer perimeters of each tunnel lining segment 30, and subsequently around an inner and outer circumference of the tunnel lining system when assembled. Further, inner and outer gaskets 33, 36 can be arranged directly on the radial walls 42 and axial walls 43 of the tunnel lining segments 30, or grooves may be formed in these radial walls 42 and axial walls 43 to accommodate inner and outer gaskets 33, 36.

The space between outer circumferential gaskets 34 and inner circumferential gaskets 36 is defined for forming a part of a circumferential grout channel. Spaces between outer axial gaskets 35, inner axial gaskets 37 and radial gasket 39 are defined for forming a part of an axial grout channel. In order to facilitate inserting grout between the assembled tunnel lining systems, grouting ports 40 are formed in radial walls 42, and these grout outlets 40 are connected to grout inlets (not shown) in inner wall 32 via ports 41.

Further, a membrane (not shown) can be applied to the inner and/or outer walls of tunnel lining segments 31 by either (i) coating the walls with a spray-applied polymer coating, e.g., epoxy, polyuria, etc., or (ii) lining the walls with a manufactured thermoplastic membrane, e.g., HDPE, PP, PVDF, ECTFE, etc. In this manner, when the tunnel lining is constructed, the membrane, as shown in FIG. 2, can be provided on the inside wall as continuous and/or segmented or combinations thereof, so as to form, with the inner and outer gaskets 33, 36, the primary air tight barrier for the system.

Tunnel lining segments 30 are constructed so that, when tunnel lining segment 30 are connected into tunnel lining systems, the outer and inner axial gaskets, as well as the radial gaskets, mateably interact and abut each other to define the axial grout channel. Further, the tunnel lining systems are constructed so that, when the tunnel lining systems are connected together to form the tunnel system, the outer and inner circumferential gaskets mateably interact with each other to define the circumferential grout channel.

Figure 5:
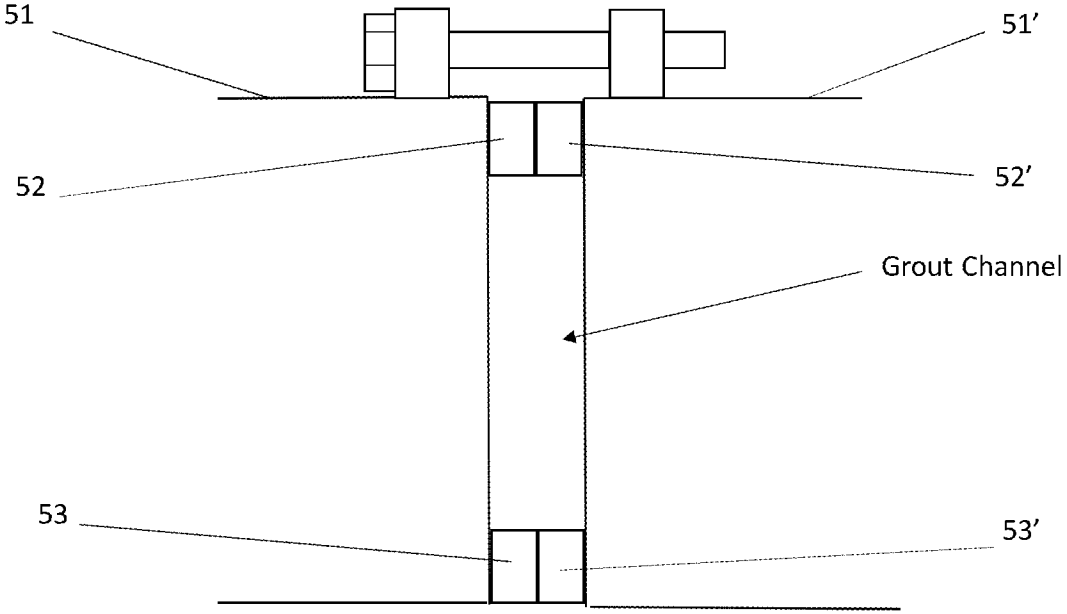
FIG. 5 illustrates an exemplary formation of grout channel.

The tunnel lining segments and the tunnel lining systems can be connected, e.g., bolted together, in order to apply compressive forces on the abutting inner and outer gaskets to achieve air tightness. An example of this is shown in FIG. 5, where two tunnel lining segments or two tunnel lining systems 51, 51' are connected together, e.g., by bolts, to apply compressive forces on abutting gaskets 52, 52' and 53, 53'. Of course it is understood that the tunnel lining segments and tunnel lining systems in accordance with the disclosed embodiments can be achieved in any manner known by those ordinarily skilled in the art to ensure that compressive forces are applied between the abutting gaskets.

Figure 4:
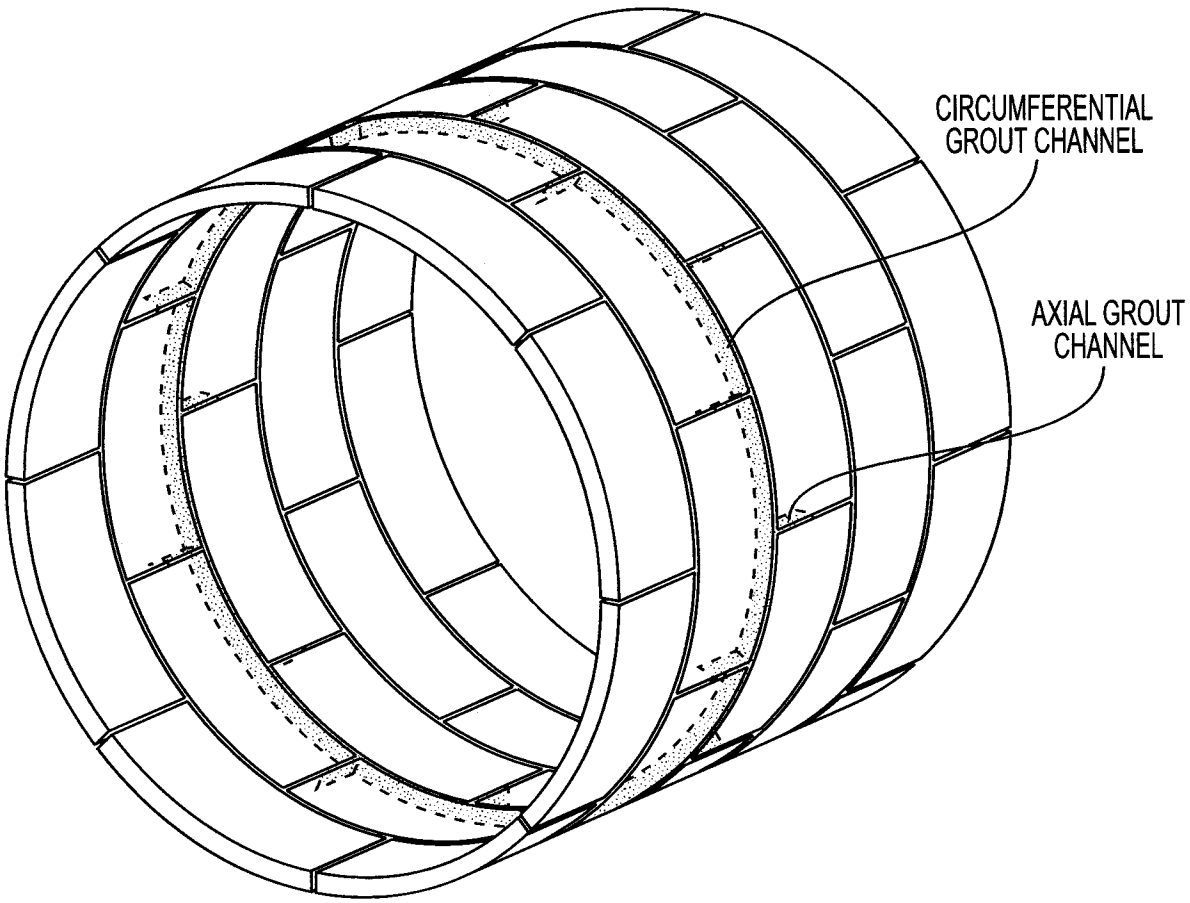
FIG. 4 illustrates the grout flow in the grout channels formed in the tunnel system.

FIG. 5 shows how the circumferential or axial grout channels are formed between the inner and outer gaskets. After the tunnel lining systems are connected together and the grout channels are defined, grout can be inserted into the grout channels via the grout inlet on the inner wall, the grout ports and the grout outlets in the radial walls of the tunnel lining segments. In this way, grout migrates into the selected circumferential grout channel and the axial grout channels to the radial gasket, as shown in FIG. 4. The grout can be an injectable synthetic grout which fills the grout channels to provide additional air-tightness of the system. Due the configuration of the grout channels in the tunnel system, flow of grout into adjacent joints is prevented.

Figure 6A:
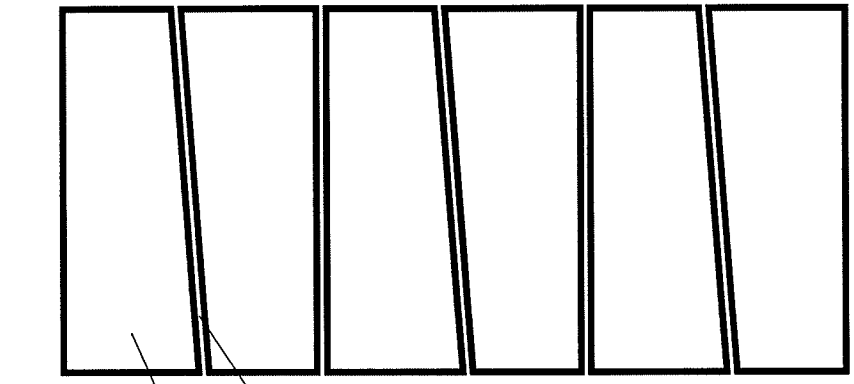
FIGS. 6A and 6B illustrate alternative tunnel lining systems to produce straight and/or curved paths.
Figure 6B:
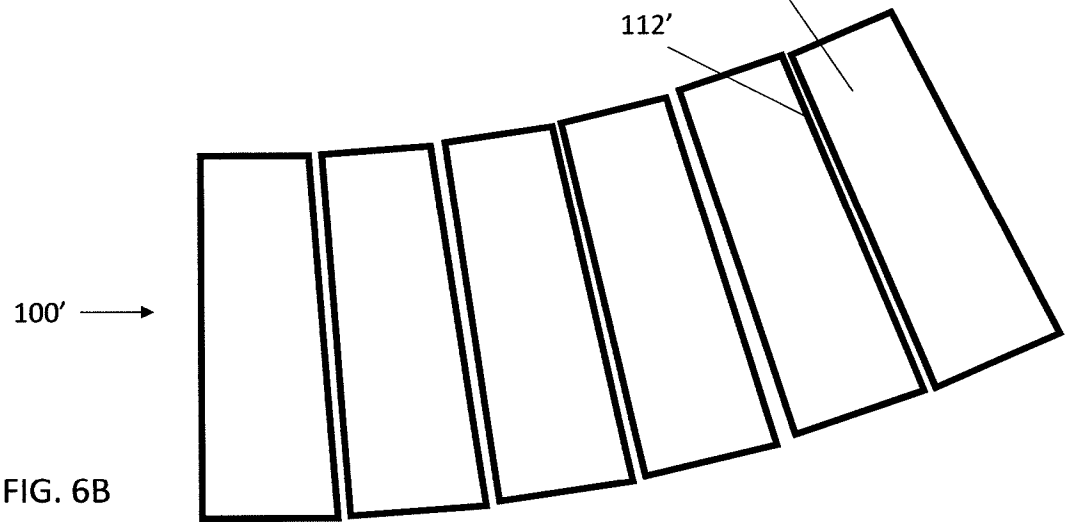

While the tunnel lining systems described above have been shown to produce a straight tunnel system, it is understood that tunnel lining systems can also be formed to facilitate the formation of curves and turns in the tunnel system. In FIG. 6A, a top view of a tunnel system 100 is shown comprising tunnel lining systems 111 and sealing systems 112. Further, in contrast to the constant length ring-shape tunnel lining systems 11 in FIG. 1, tunnel lining systems 111 have a varying length from one side to the other. While not shown in the figure, it is understood that tunnel lining systems 111 can be formed by a plurality of tunnel lining segments that, when arranged together in a ring-shaped tunnel lining system, exhibit the desired length variation for achieving the desired curve or turn for the tunnel system. When the adjacent tunnel lining systems 111 are oriented in opposite directions, the resulting tunnel system produces a straight path. However, when, as shown in FIG. 6B, adjacent tunnel lining systems 111 are oriented in same directions, the resulting tunnel system produces a curved path. Moreover, by changing the geometry of the length variation, the curves and turns can be made sharper or more gradual. Thus, while these varying length tunnel lining systems can be utilized not only for facilitating turns or curves, but can also be used to produce straight paths for the tunnel system.

Although embodiments of this disclosure have been fully described with reference to the accompanying drawings, it is to be noted that various changes and modifications will become apparent to those skilled in the art. Such changes and modifications are to be understood as claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

Insofar as the description above and the accompanying drawing disclose any additional subject matter that is not within the scope of the single claim below, the embodiments of the disclosure are not dedicated to the public and the right to file one or more applications to claim such additional embodiments of the disclosure is reserved.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the embodiments of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

Insofar as the description above and the accompanying drawing disclose any additional subject matter that is not within the scope of the claims below, the embodiments are not dedicated to the public and the right to file one or more applications to claim such additional embodiments is reserved.

What is claimed:

1. A tunnel system comprising:

at least two adjacent tunnel lining systems, the tunnel lining systems being ring-shaped and comprising an outer wall, an inner wall and radial walls, wherein the at least two adjacent tunnel lining systems are oriented so respective radial walls face each other; and a sealing system comprising at least two gaskets arranged to form a grout channel, the at least two gaskets comprising at least one outer gasket formed at least on each of the respective radial walls facing each other adjacent the outer wall and at least one inner gasket formed at least on each of the respective radial walls facing each other adjacent the inner wall, wherein the grout channel is filled with grout.

2. The tunnel system according to claim 1, wherein the at least one outer gaskets on the respective radial walls facing each other are under a compression force to abut each other and the at least one inner gaskets on the respective radial walls facing each other are under a compression force to abut each other.

3. The tunnel system according to claim 2, wherein the grout channel is defined by the abutting at least one outer gaskets, the abutting at least one inner gaskets and the respective radial walls facing each other.

4. The tunnel system according to claim 3, wherein the grout is an injectable synthetic grout, and the at least one outer and inner gaskets comprise an elastomeric rubber material.

5. The tunnel system according to claim 1, further comprising a membrane applied to the inner walls of the adjacent tunnel lining systems.

6. The tunnel system according to claim 5, wherein the membrane comprises one of a spray-applied polymer coating or thermoplastic membrane lining.

7. The tunnel system according to claim 1, wherein the tunnel lining systems comprise a plurality of tunnel lining segments.

8. The tunnel system according to claim 7, wherein the tunnel lining segments comprise an outer wall, an inner wall and axial walls, and wherein the tunnel lining segments are connected together in series at their axial walls.

9. The tunnel system according to claim 8, wherein the sealing system further comprises at least one outer gasket formed at least on the axial walls adjacent the outer wall and at least one inner gasket formed at least on the axial walls adjacent the inner wall.

10. The tunnel system according to claim 9, wherein the at least one outer gaskets on the axial walls are under a compression force to abut each other and the at least one inner gaskets on the axial walls are under a compression force to abut each other.

11. The tunnel system according to claim 9, wherein the sealing system further comprises radial gaskets on the axial walls extending between the at least one outer gaskets on the axial walls and the at least one inner gaskets on the axial walls, and wherein the radial gaskets in consecutive tunnel lining segments are under a compression force to abut each other.

12. The tunnel system according to claim 11, wherein the grout channel is further defined by the abutting at least one outer gaskets on the axial walls, the abutting at least one inner gaskets on the axial walls, the abutting radial gaskets and the axial walls.

13. The tunnel system according to claim 7, wherein the tunnel lining segments comprise an outer wall, an inner wall, radial walls and axial walls, and wherein the tunnel lining segments are connected together in series at their axial walls to form tunnel lining systems and the tunnel lining systems are connected together in series at their radial walls.

14. The tunnel system according to claim 13, wherein the sealing system further comprises at least one outer gasket surrounding a periphery of the tunnel lining segments adjacent the outer wall, at least one inner gasket surrounding a periphery of the tunnel lining segments adjacent the inner wall, and radial gaskets formed on the axial ends between the at least one outer gasket surrounding the periphery of the tunnel lining segments and the at least one inner gasket surrounding the periphery of the tunnel lining segments.

15. The tunnel system according to claim 14, wherein, when the tunnel lining segments are connected together in series at their axial walls to form tunnel lining systems, the at least one outer gaskets on consecutive axial walls are under a compression force to abut each other, the at least one inner gaskets on consecutive axial walls are under a compression force to abut each other, and the radial gaskets on consecutive axial walls are under a compression force to abut each other.

16. The tunnel system according to claim 14, wherein, when the tunnel lining systems are connected together in series at their radial walls, the at least one outer gaskets on consecutive radial walls are under a compression force to abut each other and the at least one inner gaskets on consecutive radial walls are under a compression force to abut each other.

17. The tunnel system according to claim 11, wherein the tunnel lining segments further comprise grout ports communicating between the radial wall and the inner wall.

18. The tunnel system according to claim 14, wherein the sealing system further comprises a synthetic grout filling the grout channel, which is additionally formed between consecutive axial walls and formed between consecutive radial walls.

19. The tunnel system according to claim 18, further comprising a membrane covering at least one of the inner and outer walls of the tunnel lining segments.

* * * * *